US011655687B2

(12) United States Patent
Lindahl et al.

(10) Patent No.: US 11,655,687 B2
(45) Date of Patent: May 23, 2023

(54) MODULAR ADDITIVE CEMENTING

(71) Applicant: Saudi Arabian Oil Company, Dhahran (SA)

(72) Inventors: Carl D. Lindahl, Dhahran (SA); Bandar S. Malki, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 102 days.

(21) Appl. No.: 17/315,901

(22) Filed: May 10, 2021

(65) Prior Publication Data

US 2022/0127928 A1 Apr. 28, 2022

Related U.S. Application Data

(60) Provisional application No. 63/104,962, filed on Oct. 23, 2020.

(51) Int. Cl.

| | |
|---|---|
| ***E21B 33/16*** | (2006.01) |
| ***E21B 33/14*** | (2006.01) |
| ***E21B 34/06*** | (2006.01) |

(52) U.S. Cl.

CPC ..... *E21B 33/165* (2020.05); *E21B 33/146* (2013.01); *E21B 34/063* (2013.01)

(58) Field of Classification Search

CPC ..... E21B 33/165; E21B 33/146; E21B 33/16; E21B 33/13

See application file for complete search history.

(56) References Cited

U.S. PATENT DOCUMENTS

| | | | | |
|---|---|---|---|---|
| 4,338,999 | A * | 7/1982 | Carter, Jr. | E21B 33/127 166/227 |
| 5,330,006 | A | 7/1994 | Nahm et al. | |
| 5,533,570 | A * | 7/1996 | Streich | E21B 27/02 166/333.1 |
| 5,582,251 | A | 12/1996 | Bailey et al. | |
| 5,718,287 | A | 2/1998 | Streich et al. | |
| 6,082,451 | A * | 7/2000 | Giroux | E21B 21/10 166/153 |
| 7,624,803 | B2 | 12/2009 | Daccord et al. | |
| 8,083,849 | B2 | 12/2011 | Lewis et al. | |

(Continued)

FOREIGN PATENT DOCUMENTS

| | | |
|---|---|---|
| CN | 108035694 | 5/2018 |
| WO | WO 2013044300 | 4/2013 |

(Continued)

OTHER PUBLICATIONS

PCT International Search Report and Written Opinion in International Appln. No. PCT/US2021/055782, dated Jan. 20, 2022, 12 pages.

(Continued)

*Primary Examiner* — Shane Bomar

(74) *Attorney, Agent, or Firm* — Fish & Richardson P.C.

(57) ABSTRACT

An apparatus for flowing and mixing cement within a subterranean formation includes a housing, a flow control device, and baffles. The housing is configured to contain a cement additive. The housing includes a first end and a second end. The first end is configured to couple to a cement retainer. The flow control device is disposed at the second end of the housing. The baffles are disposed within the housing.

19 Claims, 5 Drawing Sheets

(56) References Cited

U.S. PATENT DOCUMENTS

| | | | | |
|---|---|---|---|---|
| 9,810,049 | B2 * | 11/2017 | Dean | E21B 43/128 |
| 10,240,432 | B2 * | 3/2019 | Reilly | E21B 34/10 |
| 10,563,483 | B2 | 2/2020 | Steele et al. | |
| 10,590,741 | B2 | 3/2020 | Van Der Veen et al. | |
| 10,829,678 | B2 * | 11/2020 | Morgan | C09K 8/05 |
| 11,512,547 | B2 * | 11/2022 | Chamarthy | E21B 27/02 |
| 2014/0102723 | A1 * | 4/2014 | Stair | E21B 33/16 166/386 |
| 2014/0216756 | A1 * | 8/2014 | Getzlaf | E21B 7/20 166/376 |
| 2017/0016305 | A1 * | 1/2017 | Prieur | E21B 28/00 |
| 2017/0089176 | A1 * | 3/2017 | Reilly | E21B 27/02 |
| 2017/0313926 | A1 * | 11/2017 | Morgan | C04B 22/10 |
| 2018/0112488 | A1 * | 4/2018 | Budde | E21B 23/02 |
| 2019/0323307 | A1 | 10/2019 | George et al. | |
| 2022/0268114 | A1 * | 8/2022 | Egbe | E21B 34/103 |

FOREIGN PATENT DOCUMENTS

| | | |
|---|---|---|
| WO | WO 2018111103 | 6/2018 |
| WO | WO 2019099038 | 5/2019 |

OTHER PUBLICATIONS

Abubaker et al., "Technology Trial Review: Selective Coiled Tubing Re-Entry of Two Open Hole Multilateral Wells Using Intelligent Electromechanical Arm," SPE-182996-MS, Society of Petroleum Engineers (SPE), presented at the Abu Dhabi International Petroleum Exhibition & Conference, Abu Dhabi, UAE, Nov. 7-10, 2016, 14 pages.

Al-Khaldy et al., "First-Ever Level 4 Multilateral Well in North Kuwait Successfully Completed, Improves Oil Production," SPE-171792-MS, Society of Petroleum Engineers (SPE), presented at the Abu Dhabi International Petroleum Exhibition and Conference, Abu Dhabi, UAE, Nov. 10-13, 2014, 12 pages.

Arukhe et al., "Technology Evolution in a Giant Saudi Aramco's Field Development," WPC-21-0182, Work Petroleum Congress (WPC), presented at the 21st World Petroleum Congress, Moscow, Russia, Jun. 2014, 17 pages.

Saeed et al., "Multilateral Reentry System for Well Surveillance: Design, Implementation and Summary of 40 Jobs Performed in Fields," SPE-199849-MS, Society of Petroleum Engineers (SPE), presented at the SPE/ICoTA Well Intervention Conference and Exhibition, The Woodlands, Texas, Mar. 24-25, 2020, 9 pages.

* cited by examiner

MODULAR ADDITIVE CEMENTING

CROSS-REFERENCE TO RELATED APPLICATION(S)

This application claims the benefit of priority to U.S. Provisional Application Ser. No. 63/104,962, filed Oct. 23, 2020, the contents of which are hereby incorporated by reference.

TECHNICAL FIELD

This disclosure relates to downhole cementing.

BACKGROUND

A cement retainer is a tool that is set in a tubing and allows cement or other fluids to be pumped through the tool but seals against any fluid movement when the tubing is released from the tool. Cement retainers typically include slips, a ported mandrel, and rubber sealing elements, and they are typically used in squeeze cementing work. Cement retainers can be mechanically set, hydraulically set, or set via wireline. In some cases, a cement retainer cannot be unset once it has been set in a tubing but can be drilled out.

SUMMARY

This disclosure describes technologies relating to downhole cementing. Certain aspects of the subject matter described can be implemented as an apparatus for flowing and mixing cement within a subterranean formation. The apparatus includes a housing, a flow control device, and baffles. The housing is configured to contain a cement additive. The housing includes a first end and a second end opposite the first end. The first end is configured to couple to a cement retainer. The flow control device is selected from the group consisting of a rupture disc and a float valve. The flow control device is disposed at the second end of the housing. The baffles are disposed within the housing.

This, and other aspects, can include one or more of the following features.

In some implementations, the housing includes a wall connecting the first end to the second end. In some implementations, the apparatus includes a first port disposed at the first end of the housing, and the first port is configured to couple to the cement retainer. In some implementations, the apparatus includes a second port disposed at the second end of the housing. In some implementations, the apparatus includes a pressure injection port disposed at the wall of the housing.

In some implementations, the flow control device is configured to prevent fluid flow out of the housing through the flow control device up to a first pressure threshold value. In some implementations, the apparatus includes a rupture disc disposed at the wall of the housing. In some implementations, the rupture disc is configured to prevent fluid flow out of the housing through the rupture disc up to a second pressure threshold value. In some implementations, the rupture disc is configured to rupture in response to being exposed to a pressure equal to or greater than the second pressure threshold value, thereby allowing fluid flow out of the housing through the ruptured rupture disc.

In some implementations, the housing is at least partially made of polycrystalline diamond compact, and the wall is a cylindrical wall defining an outer diameter in a range of from 4 inches to 13⅜ inches.

In some implementations, each of the baffles are coupled to and protrude from an inner surface of the wall of the housing.

In some implementations, each of the baffles are sloped toward the first end of the housing.

In some implementations, the housing has a longitudinal axis defined from the first end to the second end, and each of the baffles intersect with the longitudinal axis.

Certain aspects of the subject matter described can be implemented as a method. A cement retainer coupled to an apparatus is run downhole into a wellbore formed in a subterranean formation using a tubing string. The apparatus includes a housing, a flow control device, and baffles. The housing is configured to contain a cement additive. The housing includes a first end and a second end opposite the first end. The first end is configured to couple to a cement retainer. The flow control device is selected from the group consisting of a rupture disc and a float valve. The flow control device is disposed at the second end of the housing. The baffles are disposed within the housing. The cement retainer is set within the wellbore. The cement retainer is released from the tubing string. Cement is flowed into the tubing string until the cement reaches an end of the tubing string. After the cement reaches the end of the tubing string, the tubing string is coupled to the cement retainer. The cement is flowed through the cement retainer and through the apparatus.

This, and other aspects, can include one or more of the following features.

In some implementations, the flow control device is configured to prevent fluid flow out of the housing through the flow control device up to a first pressure threshold value. In some implementations, flowing the cement through the cement retainer and through the apparatus includes flowing the cement from the cement retainer into the housing, resulting in the cement mixing with the cement additive. The mixing of the cement with the cement additive is facilitated by the plurality of baffles. In some implementations, flowing the cement through the cement retainer and through the apparatus includes flowing the cement at a pressure equal to or greater than the first pressure threshold value, such that the cement and the cement additive flow out of the housing through the flow control device.

In some implementations, the housing includes a wall connecting the first end to the second end. In some implementations, the apparatus includes a rupture disc disposed at the wall of the housing. In some implementations, the rupture disc is configured to prevent fluid flow out of the housing through the rupture disc up to a second pressure threshold value. In some implementations, the rupture disc is configured to rupture in response to being exposed to a pressure equal to or greater than the second pressure threshold value, thereby allowing fluid flow out of the housing through the ruptured rupture disc. In some implementations, the cement is flowed at a pressure equal to or greater than the second pressure threshold value, such that the cement flows out of the housing through the rupture disc. In some implementations, the second pressure threshold value is greater than the first pressure threshold value.

Certain aspects of the subject matter described can be implemented as a system. The system includes a cement retainer and an apparatus. The apparatus includes a housing, a first port, a second port, a pressure injection port, a flow control device, a rupture disc, and baffles. The housing includes a first end, a second end, and a wall connecting the first end to the second end. The first port is disposed at the first end of the housing. The first port is coupled to the cement retainer. The second port is disposed at the second end of the housing. The pressure injection port is disposed at the wall of the housing. The flow control device is selected from the group consisting of a rupture disc and a float valve. The flow control device is disposed at the second end of the housing. The flow control device is configured to prevent fluid flow out of the housing through the flow control device up to a first pressure threshold value. The rupture disc is disposed at the wall of the housing. The rupture disc is configured to prevent fluid flow out of the housing through the rupture disc up to a second pressure threshold value. The rupture disc is configured to rupture in response to being exposed to a pressure equal to or greater than the second pressure threshold value, thereby allowing fluid flow out of the housing through the ruptured rupture disc. The baffles are disposed within the housing.

This, and other aspects, can include one or more of the following features.

In some implementations, the housing is at least partially made of polycrystalline diamond compact, and the wall is a cylindrical wall defining an outer diameter in a range of from 4 inches to 13⅜ inches.

In some implementations, each of the baffles are coupled to and protrude from an inner surface of the wall of the housing.

In some implementations, each of the baffles are sloped toward the first end of the housing.

In some implementations, the housing has a longitudinal axis defined from the first end to the second end, and each of the baffles intersect with the longitudinal axis.

In some implementations, the apparatus is a first apparatus. In some implementations, the system includes a second apparatus that is substantially the same as the first apparatus. In some implementations, a first port of the second apparatus is coupled to the second port of the first apparatus.

In some implementations, a composition of a cement additive contained within the second apparatus is different from a composition of the cement additive contained within the first apparatus.

In some implementations, the second pressure threshold value is greater than the first pressure threshold value.

In some implementations, the system includes an emergency rupture disc disposed at the wall of the housing. The emergency rupture disc can be configured to prevent fluid flow out of the housing through the emergency rupture disc up to a third pressure threshold value. The emergency rupture disc can be configured to rupture in response to being exposed to a pressure equal to or greater than the third pressure threshold value, thereby allowing fluid flow out of the housing through the ruptured emergency rupture disc. In some implementations, the third pressure threshold value is greater than the first pressure threshold value. In some implementations, the third pressure threshold value is equal to or greater than the second pressure threshold value.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes downhole cementing. The modular additive cementing apparatus is configured to couple to a cement retainer and be run downhole along with the cement retainer. The apparatus includes multiple baffles and contains a cement additive. Once the cement retainer has been set within a wellbore, cement is pumped through the cement retainer and through the apparatus. The cement mixes with the cement additive within the apparatus. The baffles facilitate the mixing of the cement and the cement additive. The mixture of the cement and the cement additive flow out of the apparatus and further downhole into the wellbore. The apparatus can be used to mix the cement with the cement additive downhole (that is, within the wellbore at a desired depth) as opposed to pre-mixing the cement and the cement additive at the surface and pumping the mixture downhole.

The subject matter described in this disclosure can be implemented in particular implementations, so as to realize one or more of the following advantages. The apparatus and method described can be implemented to mitigate and/or eliminate the risk of flash setting cement during downhole cementing operations. The apparatus and method described can be implemented to increase overall efficiency in remedial cementing operations by allowing aggressive cement slurry designs to be pumped and mixed downhole in contrast to conventional apparatuses and methods that require mixing to occur before pumping the mixed slurry downhole from the surface. The apparatus and method described can allow for pump-through capability across a cement retainer positioned downhole. In some cases, the apparatus includes a rupture disc, such that in the event of plugging, rupturing the rupture disc provides an avenue of circulation. After the rupture disc has ruptured, flow is directed through the apparatus, which can cause desired additives stored within the apparatus to flow further downhole. The apparatus is configured as a modular apparatus, such that multiple implementations of the apparatus can be run in series as modular units, which can allow for increased total volume of additives and/or multiple fluid systems to be mixed and pumped, separately, downhole. In some cases, the apparatus is configured to be compatible with a retrievable cement retainer. The apparatus and method described can be implemented to pump un-accelerated cement through a cement retainer and mix, in a downhole environment, the un-accelerated cement with a cement additive including an accelerant.

Figure 1:
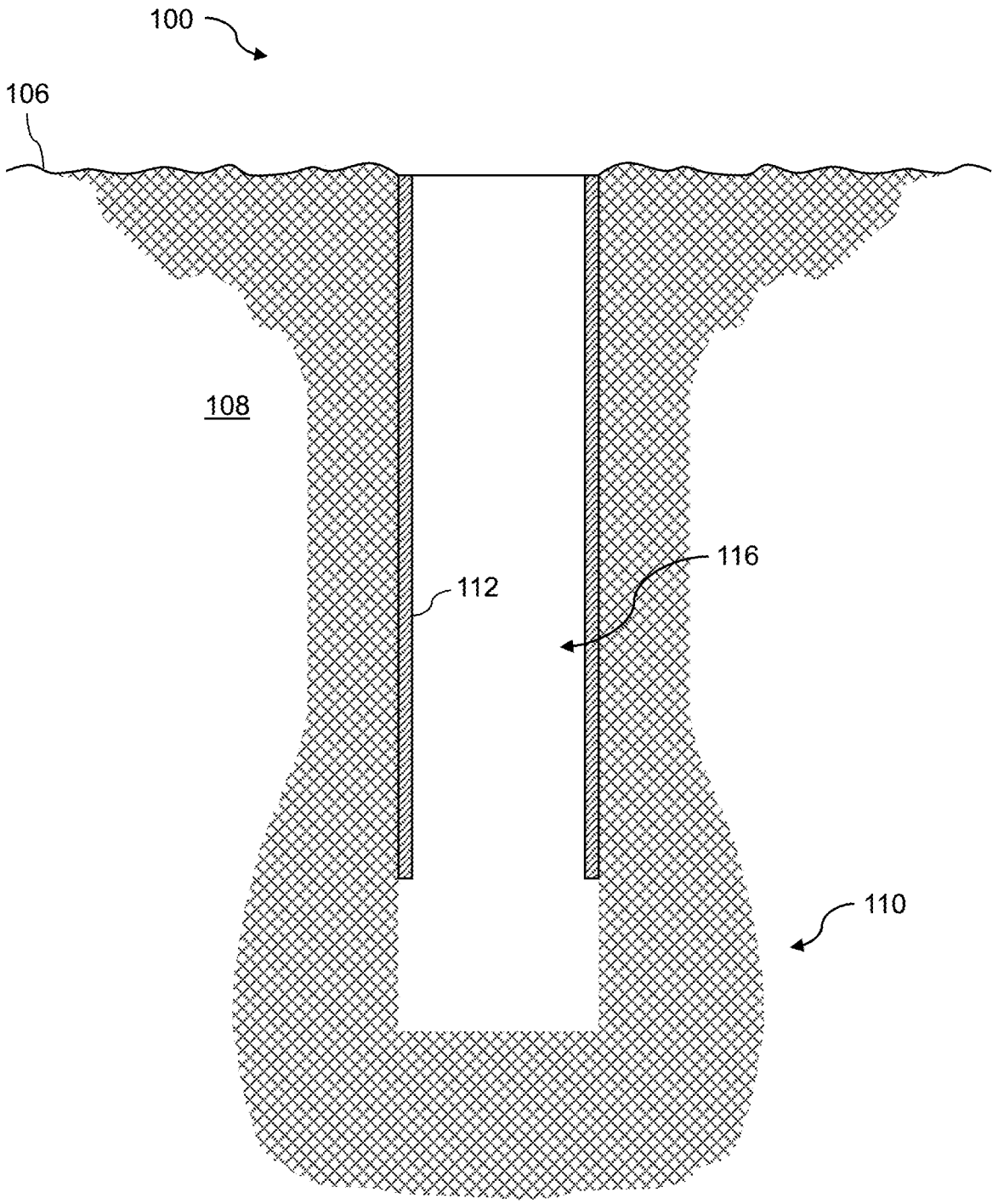
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In some implementations, the casing 112 is omitted or ceases in the region of the subterranean zone of interest 110. This portion of the well 100 without casing is often referred to as "open hole."

In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size.

Figure 2A:
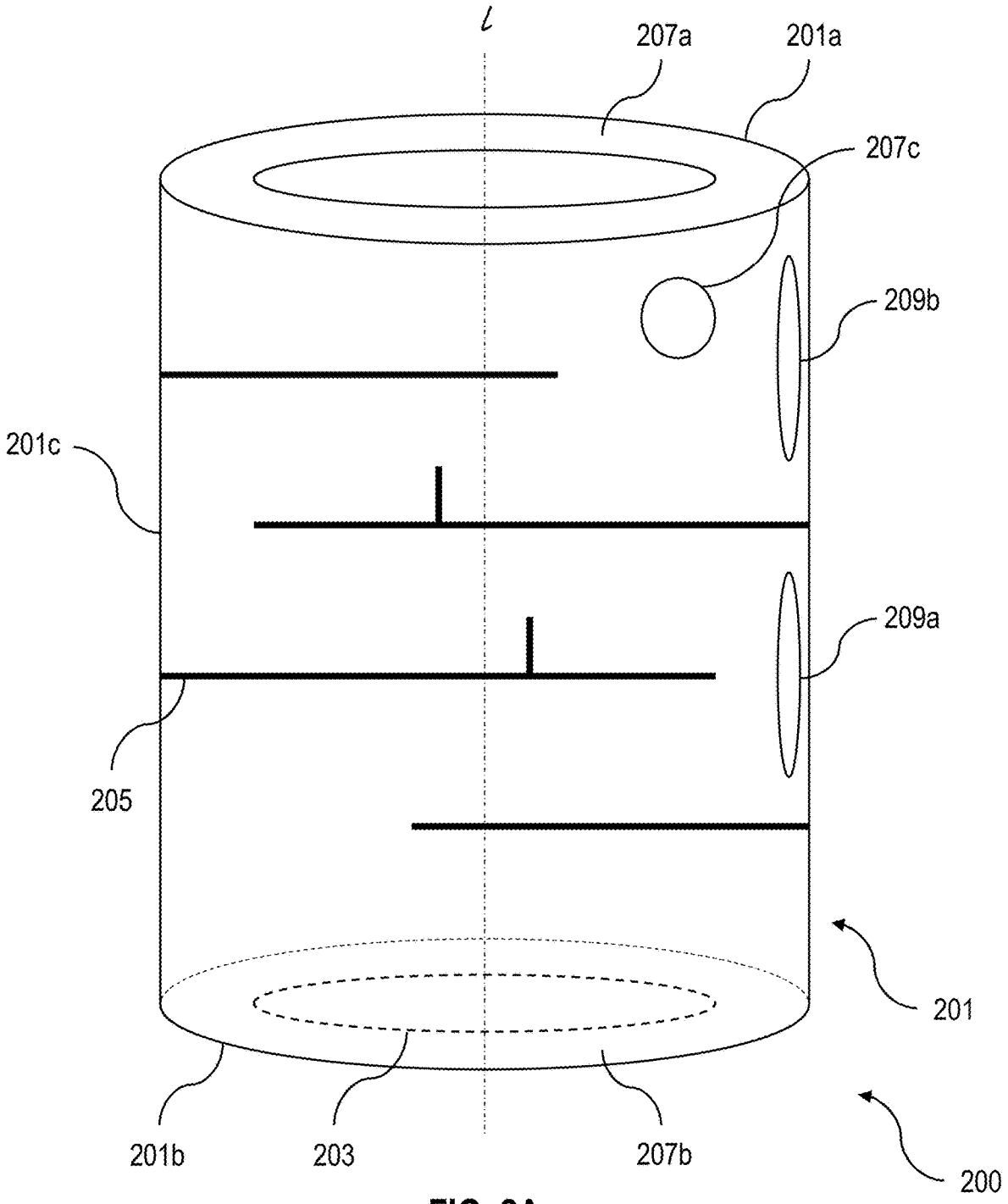
FIG. 2A is a schematic diagram of an example apparatus that can be coupled to a cement retainer.

FIG. 2A is a schematic diagram of the apparatus 200, which can be coupled to a cement retainer. The apparatus 200 includes a housing 201, a flow control device 203, and baffles 205. The housing 201 is configured to contain a cement additive. The cement additive can be liquid or dry. The housing 201 includes a first end 201*a* and a second end 201*b* opposite the first end 201*a*. The housing 201 includes a wall 201*c* connecting the first end 201*a* to the second end 201*b*. The housing 201 has a longitudinal axis/that is defined from the first end 201*a* to the second end 201*b*. The first end 201*a* is configured to couple to a cement retainer. The flow control device 203 is disposed at the second end 201*b* of the housing 201. The baffles 205 are disposed within the housing 201. The housing 201 can be at least partially made of polycrystalline diamond compact. In some implementations, the housing 201 is at least partially made of brass, aluminum, cast iron, or an epoxy-reinforced fiber glass. In some implementations, the wall 201*c* is a cylindrical wall that defines an outer diameter in a range of from 4 inches to 13⅜ inches.

The flow control device 203 is configured to prevent fluid flow out of the housing 201 through the flow control device 203 up to a first pressure threshold value. In response to being exposed to a pressure equal to or greater than the first pressure threshold value, the flow control device 203 is configured to allow fluid flow out of the housing 201 through the flow control device 203. In some implementations, the flow control device 203 is a float valve. In some implementations, the flow control device 203 is a rupture disc, in which case, the flow control device 203 is configured to rupture in response to being exposed to a pressure equal to or greater than the first pressure threshold value, thereby allowing fluid flow out of the housing 201 through the ruptured flow control device 203.

Each of the baffles 205 are coupled to and protrude from an inner surface of the wall 201*c* of the housing 201. In some implementations, one or more of the baffles 205 are sloped toward the first end 201*a* of the housing 201. In some implementations, one or more of the baffles 205 intersect with the longitudinal axis 1.

In some implementations, the apparatus 200 includes a first port 207*a* that is disposed at the first end 201*a* of the housing 201. The first port 207*a* can be configured to couple to the cement retainer. In some implementations, the apparatus 200 includes a second port 207*b* that is disposed at the second end 201*a* of the housing 201. In some implementations, the first port 207*a* is configured to couple to the second port 207*b* of another implementation of the apparatus 200. An example of a system including multiple implementations of the apparatus 200 coupled together is shown in FIG. 2C and described in more detail later.

In some implementations, the apparatus 200 includes a pressure injection port 207*c* that is disposed at the wall 201*c* of the housing 201. In some implementations, the pressure injection port 207*c* includes a check valve that allows fluid flow in one direction (for example, into the housing 201) and prevents fluid flow in an opposite direction (for example, out of the housing 201) through the check valve. The pressure injection port 207*c* can be used to pressurize the internal volume of the housing 201, which can help to mitigate and/or prevent collapse of the housing 201, for example, while being run downhole and/or being exposed to a downhole environment.

In some implementations, the apparatus 200 includes a secondary rupture disc 209*a* that is disposed at the wall 201*c* of the housing 201. The secondary rupture disc 209*a* is configured to prevent fluid flow out of the housing 201 through the secondary rupture disc 209*a* up to a second pressure threshold value. The second pressure threshold value can be greater than the first pressure threshold value. In response to being exposed to a pressure equal to or greater than the second pressure threshold value, the secondary rupture disc 209*a* is configured to rupture, thereby allowing fluid flow out of the housing 201 through the ruptured secondary rupture disc 209*a*.

In some implementations, the apparatus 200 includes an emergency rupture disc 209*b* that is disposed at the wall

201*c* of the housing 201. The emergency rupture disc 209*b* is configured to prevent fluid flow out of the housing 201 through the emergency rupture disc 209*b* up to a third pressure threshold value. The third pressure threshold value can be greater than the first pressure threshold value. The third pressure threshold value can be equal to or greater than the second pressure threshold value. In response to being exposed to a pressure equal to or greater than the third pressure threshold value, the emergency rupture disc 209*b* is configured to rupture, thereby allowing fluid flow out of the housing 201 through the ruptured emergency rupture disc 209*b*.

Figure 2B:
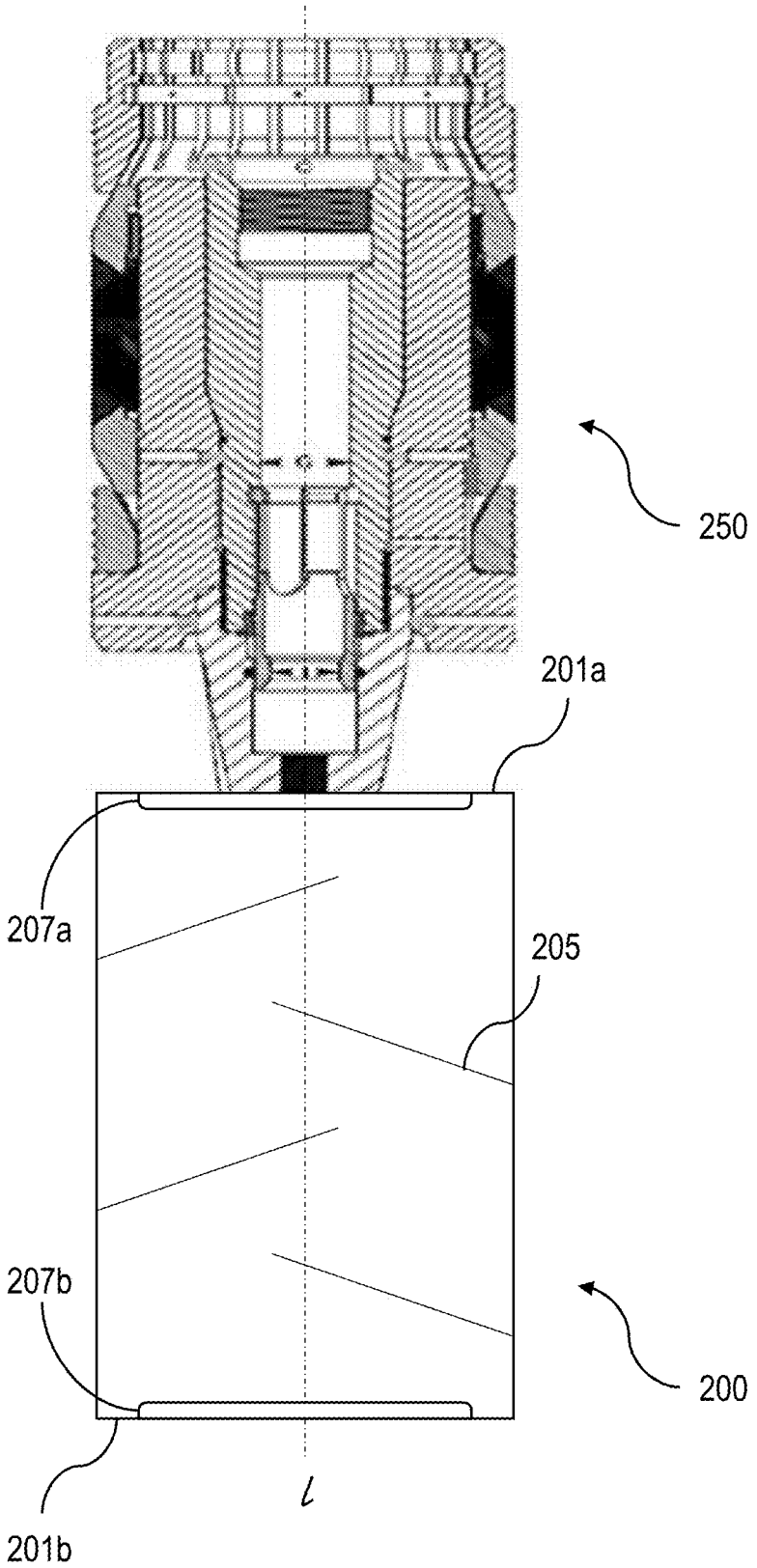
FIG. 2B is a schematic diagram of the apparatus of FIG. 2A coupled to a cement retainer.
Figure 2C:
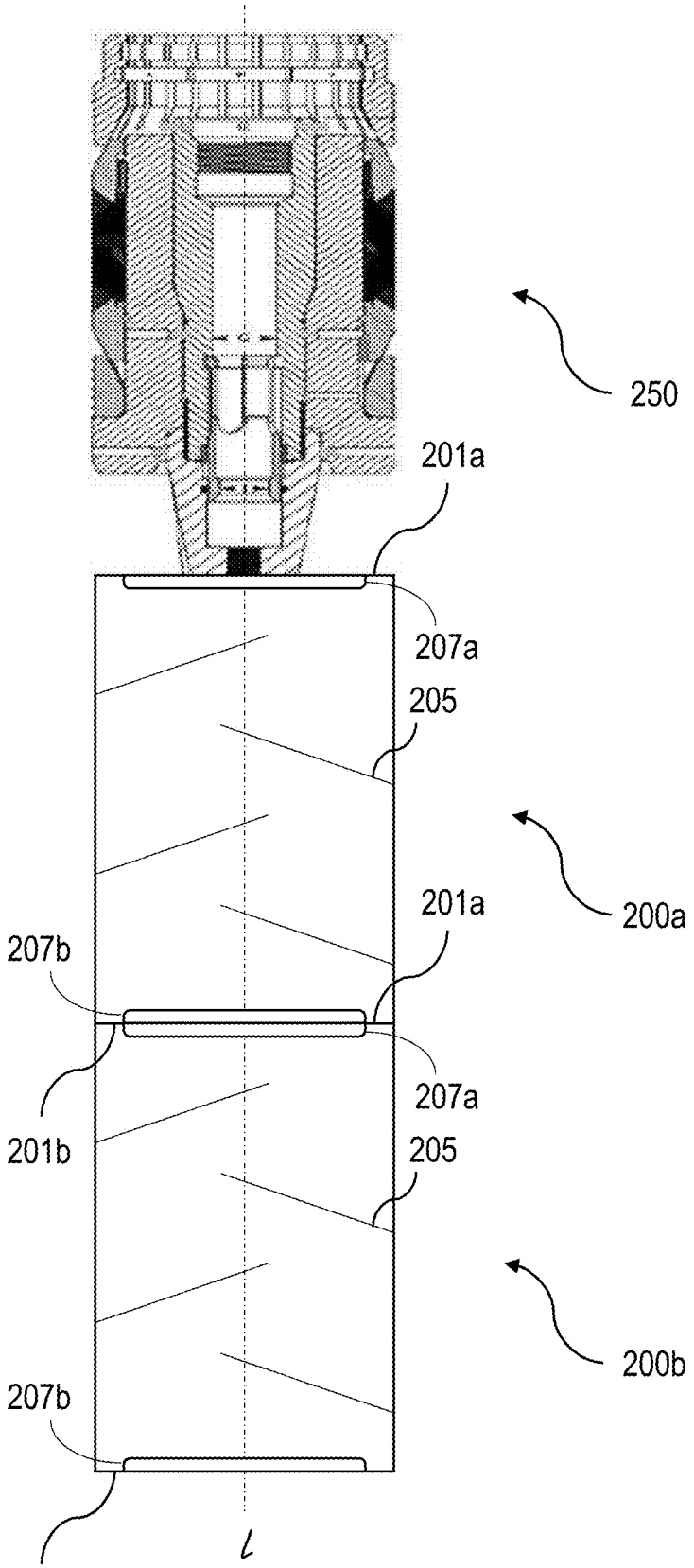
FIG. 2C is a schematic diagram of an example system including an implementation of the apparatus of FIG. 2A coupled to a cement retainer.

FIG. 2B is a schematic diagram of the apparatus 200 coupled to a cement retainer 250. As depicted in FIG. 2B, the first port 207*a* is coupled to the cement retainer 250. The cement retainer 250 coupled to the apparatus 200 can be run downhole into a wellbore formed in a subterranean formation (for example, the well 100). Once the cement retainer 250 is set in the wellbore, cement can be flowed through the cement retainer 250 and the apparatus 200. As the cement flows through the apparatus 200, the cement mixes with the cement additive contained within the apparatus 200. The mixing of the cement and the cement additive is facilitated by the baffles 205. The mixture of the cement and the cement additive can flow out of the apparatus 200 (for example, through the flow control device 203) and further downhole into the wellbore. Although FIG. 2B shows an uphole end (first end 201*a*) of the apparatus 200 being coupled to a downhole end of the cement retainer 250, the apparatus 200 can be coupled to an uphole end of the cement retainer 250. For example, a downhole end (second end 201*b*) of the apparatus 200 can be coupled to the uphole end of the cement retainer 250. In such implementations where the apparatus 200 is coupled to the uphole end of the cement retainer 250, a mechanical setting procedure can be implemented, which can allow for cement and/or additives to be pumped and for the apparatus 200 to be milled prior to the slips of the cement retainer 250. The mechanical setting procedure can decrease and/or eliminate the possibility of debris from falling downhole into the wellbore.

FIG. 2C is a schematic diagram of a system 290 including multiple implementations of the apparatus 200 coupled to the cement retainer 250. As depicted in FIG. 2C, the system 290 includes a first apparatus 200*a* and a second apparatus 200*b*. Each of the first apparatus 200*a* and the second apparatus 200*b* can include the same components as the apparatus 200 shown in FIG. 2A. In some implementations, the first apparatus 200*a* and the second apparatus 200*b* contain the same cement additive (for example, to meet a desired total volume of the cement additive). For example, the cement additive contained in the first apparatus 200*a* has the same composition as the cement additive contained in the second apparatus 200*b*. In some implementations, the first apparatus 200*a* and the second apparatus 200*b* contain different cement additives (for example, to prevent mixing of the different cement additives before introducing the cement at a desired depth within the wellbore). For example, the cement additive contained in the first apparatus 200*b* has a different composition from the cement additive contained in the second apparatus 200*b*. Although shown as including two apparatuses 200*a*, 200*b*, the system 290 can include additional implementations of the apparatus 200 (for example, three, four, or more than four).

As depicted in FIG. 2C, the first port 207*a* of the first apparatus 200*a* is coupled to the cement retainer 250, and the first port 207*a* of the second apparatus 200*b* is coupled to the second port 207*b* of the first apparatus 200*a*. The cement retainer 250 coupled to the apparatuses 200*a*, 200*b* can be run downhole into a wellbore formed in a subterranean formation (for example, the well 100). Once the cement retainer 250 is set in the wellbore, cement can be flowed through the cement retainer 250 and the apparatuses 200*a*, 200*b*. As the cement flows through the first apparatus 200*a*, the cement mixes with the cement additive contained within the first apparatus 200*a* to form a first mixture. The mixing of the cement and the cement additive to form the first mixture is facilitated by the baffles 205 of the first apparatus 200*a*. The first mixture can flow out of the first apparatus 200*a* (for example, through the flow control device 203 of the first apparatus 200*a*) and into the second apparatus 200*b*. As the first mixture flows through the second apparatus 200*b*, the first mixture mixes with the cement additive contained within the second apparatus 200*b* to form a second mixture. The mixing of the first mixture and the cement additive to form the second mixture is facilitated by the baffles 205 of the second apparatus 200*b*. The second mixture can flow out of the second apparatus 200*b* (for example, through the flow control device 203 of the second apparatus 200*b*) and further downhole into the wellbore. Although FIG. 2C shows an uphole end (first end 201*a*) of the apparatus 200*a* being coupled to a downhole end of the cement retainer 250, the apparatuses 200*a* and 200*b* can be coupled to an uphole end of the cement retainer 250. For example, a downhole end (second end 201*b*) of apparatus 200*a* can be coupled to an uphole end (first end 201*a*) of the apparatus 200*b*, and a downhole end (201*b*) of the apparatus 200*b* can be coupled to the uphole end of the cement retainer 250.

Figure 3:
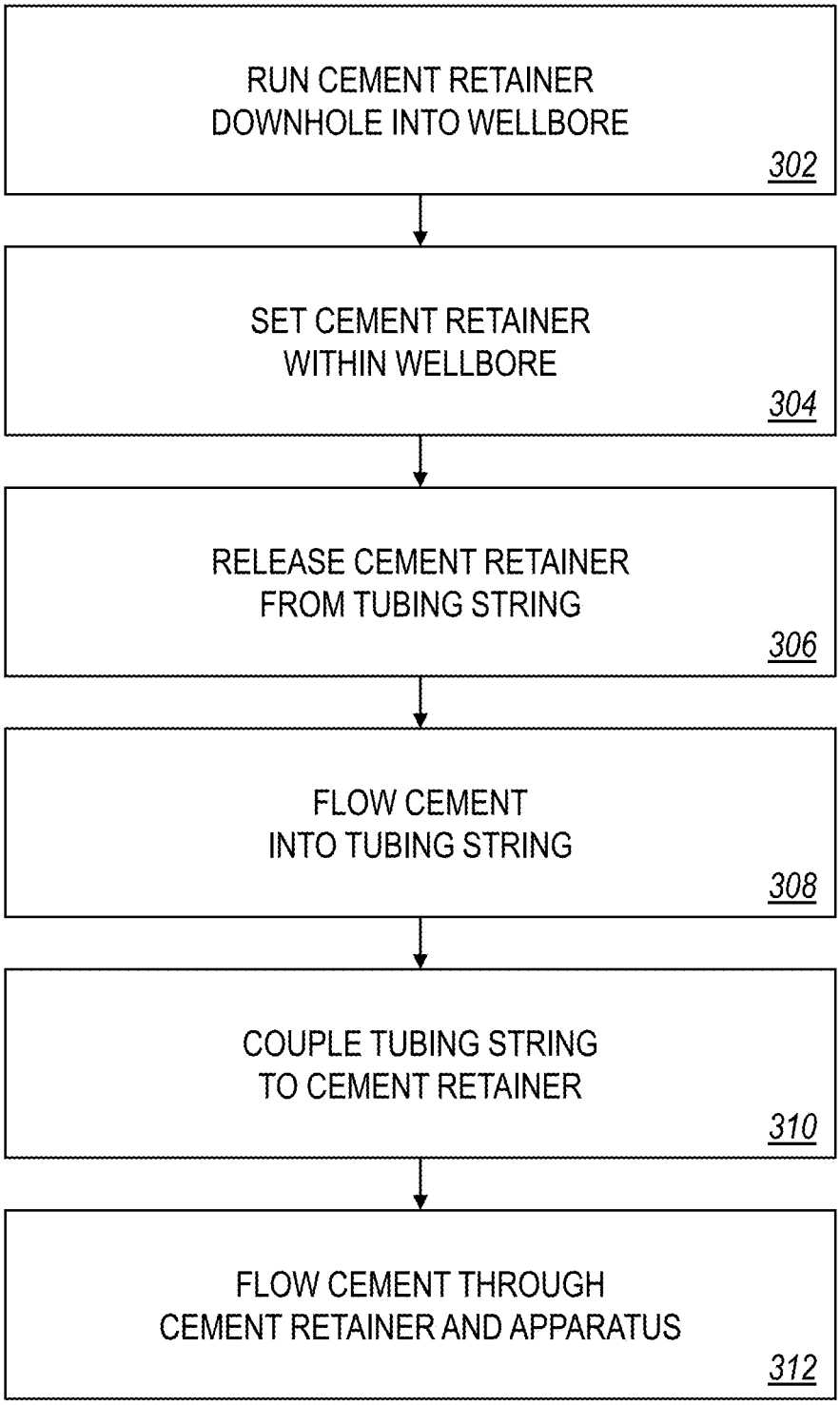
FIG. 3 is a flow chart of an example method for using the apparatus of FIG. 2A.

FIG. 3 is a flow chart of a method 300 which can be implemented using the apparatus 200. At step 302, a cement retainer (such as the cement retainer 250) is run downhole into a wellbore formed in a subterranean formation (such as the well 100) using a tubing string. The cement retainer 250 is coupled to the apparatus 200. The cement retainer 250 and the apparatus 200 are run downhole together into the wellbore at step 302. As described previously, the apparatus 200 includes the housing 201, the flow control device 203, and the baffles 205. The housing 201 contains a cement additive.

Once the cement retainer 250 is at a desired depth within the wellbore, the cement retainer 250 is set within the wellbore at step 304. For example, the cement retainer 250 is coupled to the casing 112. The cement retainer 250 can be set within the wellbore at step 304 mechanically with a mechanical setting tool, hydraulically by applying hydraulic force from the surface 106, or using a wireline pressure setting tool, in which the cement retainer 250 is run on an electrical conductor wireline.

At step 306, the cement retainer 250 is released from the tubing string.

At step 308, cement is flowed into the tubing string until the cement reaches an end (for example, the downhole end) of the tubing string.

After the cement reaches the end of the tubing string at step 308, the tubing string is re-coupled to the cement retainer 250 at step 310.

At step 312, the cement is flowed from the tubing string through the cement retainer 250 and through the apparatus 200. In some implementations, flowing the cement through the cement retainer 250 and through the apparatus 200 at step 312 includes flowing the cement from the cement retainer 250 into the housing 201, resulting in the cement mixing with the cement additive contained within the housing 201. The mixing of the cement and the cement additive is facilitated by the baffles 205. In some implementations, flowing the cement through the cement retainer 250 and through the apparatus 200 at step 312 includes flowing the cement at a pressure that is equal to or greater than the first pressure threshold value, such that the mixture of the cement and the cement additive flow out of the housing 201 through the flow control device 203.

Flowing the cement into the tubing string until the cement reaches the end of the tubing string at step 308 before flowing the cement through the apparatus 200 at step 312 mitigates and/or eliminates the risk of prematurely flowing the cement additive out of the housing 201 before the cement additive has mixed with the cement.

In some implementations, the method 300 includes flowing the cement at a pressure equal to or greater than the second pressure threshold value, such that secondary rupture disc 209*a* ruptures, and the cement flows out of the housing 201 through the ruptured secondary rupture disc 209*a*. In some implementations, the method 300 includes flowing the cement at a pressure equal to or greater than the third pressure threshold value, such that emergency rupture disc 209*b* ruptures, and the cement flows out of the housing 201 through the ruptured emergency rupture disc 209*b*.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. An apparatus for flowing and mixing cement within a subterranean formation, the apparatus comprising:

a housing configured to contain a cement additive, the housing comprising:

a first end;

a second end opposite the first end; and a wall connecting the first end to the second end;

a first port disposed at the first end of the housing, the first port configured to couple to a cement retainer;

a second port disposed at the second end of the housing;

a pressure injection port disposed at the wall of the housing;

a flow control device selected from the group consisting of a rupture disc and a float valve, the flow control device disposed at the second end of the housing; and a plurality of baffles disposed within the housing.

2. The apparatus of claim 1, wherein:

the flow control device is configured to prevent fluid flow out of the housing through the flow control device up to a first pressure threshold value; and the apparatus comprises a rupture disc disposed at the wall of the housing, the rupture disc configured to prevent fluid flow out of the housing through the rupture disc up to a second pressure threshold value, the rupture disc configured to rupture in response to being exposed to a pressure equal to or greater than the second pressure threshold value, thereby allowing fluid flow out of the housing through the ruptured rupture disc.

3. The apparatus of claim 2, wherein the housing is at least partially made of polycrystalline diamond compact, and the wall is a cylindrical wall defining an outer diameter in a range of from 4 inches to 13⅜ inches.

4. The apparatus of claim 2, wherein each of the plurality of baffles are coupled to and protrude from an inner surface of the wall of the housing.

5. The apparatus of claim 4, wherein each of the plurality of baffles are sloped toward the first end of the housing.

6. The apparatus of claim 5, wherein the housing has a longitudinal axis defined from the first end to the second end, and each of the plurality of baffles intersect with the longitudinal axis.

7. A method comprising:

running a cement retainer downhole into a wellbore formed in a subterranean formation using a tubing string, the cement retainer coupled to an apparatus comprising:

a housing containing a cement additive, the housing comprising a first end coupled to the cement retainer and a second end opposite the first end;

a flow control device selected from the group consisting of a rupture disc and a float valve, the flow control device disposed at the second end of the housing; and a plurality of baffles disposed within the housing;

setting the cement retainer within the wellbore;

releasing the cement retainer from the tubing string;

flowing cement into the tubing string until the cement reaches an end of the tubing string;

after the cement reaches the end of the tubing string, coupling the tubing string to the cement retainer; and flowing the cement through the cement retainer and through the apparatus.

8. The method of claim 7, wherein:

the flow control device is configured to prevent fluid flow out of the housing through the flow control device up to a first pressure threshold value; and flowing the cement through the cement retainer and through the apparatus comprises:

flowing the cement from the cement retainer into the housing, resulting in the cement mixing with the cement additive, facilitated by the plurality of baffles; and flowing the cement at a pressure equal to or greater than the first pressure threshold value, such that the cement and the cement additive flow out of the housing through the flow control device.

9. The method of claim 8, wherein:

the housing comprises a wall connecting the first end to the second end;

the apparatus comprises a rupture disc disposed at the wall of the housing, the rupture disc configured to prevent fluid flow out of the housing through the rupture disc up to a second pressure threshold value, the rupture disc configured to rupture in response to being exposed to a pressure equal to or greater than the second pressure threshold value, thereby allowing fluid flow out of the housing through the ruptured rupture disc; and the method comprises flowing the cement at a pressure equal to or greater than the second pressure threshold value, such that the cement flows out of the housing through the rupture disc.

10. The method of claim 9, wherein the second pressure threshold value is greater than the first pressure threshold value.

11. A system comprising:

a cement retainer; and an apparatus comprising:

a housing configured to be positioned downhole, the housing containing a cement additive, the housing comprising:

a first end;

a second end; and a wall connecting the first end to the second end;

a first port disposed at the first end of the housing, the first port coupled to the cement retainer;

a second port disposed at the second end of the housing;

a pressure injection port disposed at the wall of the housing;

a flow control device selected from the group consisting of a rupture disc and a float valve, the flow control device disposed at the second end of the housing, the flow control device configured to prevent fluid flow out of the housing through the flow control device up to a first pressure threshold value;

a rupture disc disposed at the wall of the housing, the rupture disc configured to prevent fluid flow out of the housing through the rupture disc up to a second pressure threshold value, the rupture disc configured to rupture in response to being exposed to a pressure equal to or greater than the second pressure threshold value, thereby allowing fluid flow out of the housing through the ruptured rupture disc; and a plurality of baffles disposed within the housing.

12. The system of claim 11, wherein the housing is at least partially made of polycrystalline diamond compact, and the wall is a cylindrical wall defining an outer diameter in a range of from 4 inches to 13⅜ inches.

13. The system of claim 11, wherein each of the plurality of baffles are coupled to and protrude from an inner surface of the wall of the housing.

14. The system of claim 13, wherein each of the plurality of baffles are sloped toward the first end of the housing.

15. The system of claim 14, wherein the housing has a longitudinal axis defined from the first end to the second end, and each of the plurality of baffles intersect with the longitudinal axis.

16. The system of claim 11, wherein:

the apparatus is a first apparatus;

the system comprises a second apparatus substantially the same as the first apparatus; and a first port of the second apparatus is coupled to the second port of the first apparatus.

17. The system of claim 16, wherein a composition of the cement additive contained within the second apparatus is different from a composition of the cement additive contained within the first apparatus.

18. The system of claim 11, wherein the second pressure threshold value is greater than the first pressure threshold value.

19. The system of claim 11, comprising an emergency rupture disc disposed at the wall of the housing, the emergency rupture disc configured to prevent fluid flow out of the housing through the emergency rupture disc up to a third pressure threshold value, the emergency rupture disc configured to rupture in response to being exposed to a pressure equal to or greater than the third pressure threshold value, thereby allowing fluid flow out of the housing through the ruptured emergency rupture disc, wherein the third pressure threshold value is greater than the first pressure threshold value, and the third pressure threshold value is equal to or greater than the second pressure threshold value.

* * * * *